United States Patent [19]

Cailloux

[11] 4,257,194

[45] Mar. 24, 1981

[54] APPARATUS FOR MACHINING, WORKPIECES HAVING CURVED SURFACES, E.G. LENSES

[75] Inventor: Jean-Francois Cailloux, Le Raincy, France

[73] Assignee: Essilor International "Cie Generale d'Optique", Creteil, France

[21] Appl. No.: 30,431

[22] Filed: Apr. 16, 1979

[30] Foreign Application Priority Data

Apr. 25, 1978 [FR] France ..... 78 12190

[51] Int. Cl.[3] ..... B24B 13/02

[52] U.S. Cl. ..... 51/57; 51/124 L; 51/58

[58] Field of Search ..... 51/35, 54, 55, 57, 58, 51/60, 65, 115, 119, 120, 124 L, 160, 93

[56] References Cited

U.S. PATENT DOCUMENTS

| | | | |
|---|---|---|---|
| 1,001,410 | 8/1911 | Johnson | 51/60 |
| 1,460,724 | 7/1923 | McGrath | 51/55 |
| 1,609,963 | 12/1926 | Robinson | 51/65 |
| 2,303,531 | 12/1942 | Eyster | 51/120 |
| 2,352,146 | 6/1944 | De Senberg | 51/55 |
| 2,371,303 | 3/1945 | Liebowitz | 51/57 |
| 3,389,508 | 6/1968 | Suddarth | 51/60 |
| 3,782,042 | 1/1974 | Strasbaugh | 51/58 |
| 3,900,971 | 8/1975 | Brueck | 51/55 |
| 3,900,972 | 8/1975 | Rupp | 51/58 |
| 4,143,490 | 3/1979 | Wood | 51/58 |

FOREIGN PATENT DOCUMENTS

| | | | |
|---|---|---|---|
| 138954 | 10/1950 | Australia | 51/160 |

*Primary Examiner*—Harold D. Whitehead
*Assistant Examiner*—K. Bradford Adolphson
*Attorney, Agent, or Firm*—Charles E. Brown

[57] ABSTRACT

Apparatus for machining, polishing and/or smoothing workpieces having curved surfaces such as optical or ophthalmic lenses. A bearing head maintains a tool against a workpiece. Pressure is applied by a pneumatic piston and cylinder unit for establishing contact pressure between the workpiece and the tool. An eccentric drive mechanism including a compound table generates relative displacement between the workpiece and the tool. The pneumatic piston and cylinder unit actually forms part of the tool holder spindle. The cylinder or piston rod of the unit is provided with a tool holder block mounting the tool and the other of the piston rod or cylinder is attached to the drive mechanism. The bearing head has a freely rotating position and a locked position preventing rotation.

9 Claims, 7 Drawing Figures

APPARATUS FOR MACHINING, WORKPIECES HAVING CURVED SURFACES, E.G. LENSES

FIELD OF THE INVENTION

The present invention relates generally to the machining of workpieces, in particular workpieces having curved surfaces, such as ophthalmic lenses, optical lenses or the like, and more particularly to the ultimate stage of machining comprising the smoothing and/or polishing of such workpieces.

DESCRIPTION OF THE PRIOR ART

Such as described in French printed patent specification No. 2,155,195 and U.K. Pat. No. 1,311,851 the machines usually employed for such machining and/or polishing comprise, generally speaking, a tool holder spindle, a bearing head adapted to maintain the tool against the workpiece, pressure-applying means operatively disposed between the tool holder spindle and the bearing head for establishing contact pressure between the workpiece and the tool, drive means also operatively disposed between the tool holder spindle and the bearing head for generating predetermined displacements of the workpiece relative to the tool.

In practice, as is the case with each of the above identified patent specifications the tool holder spindle is provided with a tool holder block adapted to receive the tool. Likewise each of these patent publications the tool holder spindle is fixed axially and the pressure-applying means adapted to establish contact pressure between the workpiece and the tool and acting on the associated bearing head comprise a pneumatic piston and cylinder unit.

In U.S. Pat. No. 3,838,542, however, the tool is urged by the bearing head and a workpiece holder spindle provides very slight axial movement. Similarly the workpiece holder spindle carries the workpiece and is urged by a piston and cylinder unit which in this patent is hydraulically operated for adjusting the starting work position and thereafter, in operation, it affords consistant positive bearing contact.

Machines of the foregoing type have various drawbacks. The first, and most important, results from the fact that the overall kinetics of the pressure-applying means owing to the relative displacement of the workpiece and the tool results in variations in contact pressure between the workpiece and the tool, which contact pressure is greater when the spindle is in alignment with the pressure-applying means than when it is inclined in relative thereto. This is particularly the case in the above French patent specification where the pressure-applying means act in a vertical plane irrespective of the position of the workpiece relative to the tool. This variation in contact pressure, which is appreciable, inevitably causes very substantial local deformations in the curvature of the workpieces.

Another drawback of such heretofore known machines lies in the nature of the means utilized for attaching the tool holder spindle to drive means imparting movement, which may be described as orbital, resulting from the combination of the various simultaneous movements.

In French printed patent specification No. 2,155,195, a ball joint is used for this purpose which is likewise the case in the British patent specification No. 1,311,851.

Such parts are inevitably subject to wear and such wear inevitably causes irregular action of the tool.

Finally, and this is their third drawback, such machines are specially adapted for machining a toroidal or cylindrical surface. To be sure, in the field of ophthalmic machining the active surface of such a lens is most often toroidal concave.

Yet the other surface of such an opthalmic lens which may be simply spherical also has to be machined. To date, the machining of such a spherical surface most often necessitates the utilization of another machine.

An object of the invention is to obviate such drawbacks.

SUMMARY OF THE INVENTION

According to the invention there is provided an apparatus for machining workpieces, in particular curved workpieces, such as ophthalmic or optical lens or the like, such a machine being of the type comprising tool holder spindle, a bearing head for maintaining the tool against the workpiece, pressure-applying means including a pneumatic piston and cylinder unit operatively disposed between the tool holder spindle and the bearing head for establishing contact pressure between the workpiece and the tool, drive means also operative between the tool holder spindle and the bearing head for generating predetermined displacements of the workpiece relative to the tool, characterized by the pneumatic piston and cylinder unit being part of the tool holder spindle, a selected one of the piston and cylinder of the piston and cylinder unit being provided with a tool holder block adapted to mount the tool, and the non-selected one of the piston and cylinder being attached to the drive means.

Thus according to the invention the pneumatic piston and cylinder unit of the pressure-applying means is incorporated into the tool holder spindle and comprises an integral part thereof. Accordingly the tool holder spindle which is both driven for orbital movement and comprises a movable axial portion, i.e. the piston rod of the piston and cylinder unit continuously applies constant pressure to the tool irrespective of its inclination relative to the vertical and the position of the workpiece relative to the tool thereby advantageously minimizing the variations in contact pressure between the workpiece and the tool.

This is all the more so as, preferably, the bearing head is disposed at the extremity of a bellcrank fixed for rotation with an alternating drive mechanism whereby the bearing head is imparted with swinging movement relative to the tool holder spindle.

Moreover the connection between the pneumatic unit comprising the tool holder spindle and the drive means attached thereto comprises an elastic coupling, that is, a coupling permitting some axial displacement of the support spindle and some swinging thereof but precluding any radial displacement of the tool holder spindle, said drive means comprise compound movement table, in other words a table mounted for movement in orthogonal directions attached to eccentric drive mechanism.

As far as the elastic coupling is concerned wear poses no problem. As for the compound table all that is subjected to wear is the ball bearings employed for guiding the table which may easily be accommodated by tightening the sleeves.

It follows that the present machine requires only minimal maintenance which may be accomplished quickly.

Furthermore as no positive, rigid connection exists between and the tool and the drive means, the only connection being effected by pneumatic means and elastic means, no stress is likely to develop between the tool and the drive means and there is no likelihood that the tool will apply an inordinate thrust capable of damaging a machined workpiece.

Although the present machine is essentially provided for machining a toroidal or cylindrical surface it is equally well adapted to machine spherical or even planar surfaces.

To this end the bearing head of the machine is freely rotatably mounted and lockable or securable in position on a support pin extending generally transversely relative to the tool holder spindle, said bearing head carrying a single bearng finger and a pair of parallel bearing fingers respectively in diametrically opposed positions relative to the support pin.

When machining toroidal or cylindrical surfaces which, as mentioned above, is most frequently the case, the bearing head is freely rotatably mounted on the support shaft and it is oriented in operation so that the two parallel bearing fingers engage the workpiece, the holder spindle being in this case the tool holder spindle.

The two bearing fingers thus employed prevent any rotation of the workpiece which in cooperation with the guiding of the compound table movements provides a centering of the workpiece relative to the tool necessary for the toroidal or cylindrical machining sought, that is to say, maintaining a preferred rectilinear axis of displacement of the workpiece relative to the tool.

On the other hand when machining a spherical surface, the bearing head is locked or secured for rotation about its support pin which is quickly and easily accomplished according to the orientation of its single bearing finger which is then operative.

Further in this case the workpiece is disposed without any particular packing in a box mounted on a work holder block of the spindle, and the tool is urged by the bearing head. As this bearing head bears against the tool only by its single bearing finger, the tool is free to rotate about its axis relative to the workpiece being machined and owing to the contact forces developing between the tool and the workpiece, the tool starts to rotate thereby ensuring the uniformity of the spherical machining sought.

To further enhance this unifomity the drive means attached to the spindle are periodically alternately driven for rotation in one direction and then the other.

BRIEF DESCRIPTION OF THE DRAWINGS

These and another features and advantages of the invention will become further apparent from the description which follows, given by way of example, with reference to the accompanying schematic drawings, in which.

DETAIL DESCRIPTION OF THE DRAWINGS

Figure 1:
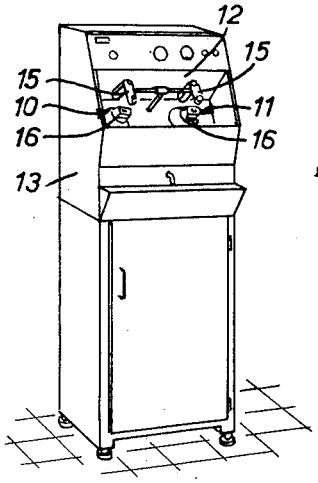
FIG. 1 is a perspective view of the front of a machine embodying the present invention.

In the illustrated embodiment shown in the accompanying figures the machine comprises two work stations 10 and 11 disposed horizontally side by side and accessible in a front-opening rectangular recess in a cabinet or fairing 13. Each work station comprises (see FIG. 1 in particular) a bearing head indicated overall by numeral 15 and a holder spindle, here a tool holder spindle, indicated by general reference number 16, the tool holder spindle extending rearwards relative to the lower end of the bearing head 15.

The tool holder spindle 16 comprises a pneumatic piston and cylinder unit 17 with its cylinder 19 which is swivelly mounted by means of a ball joint 20 on a transverse interior partition 22 fixed to the sidewalls of the cabinet 13 and defining the endwall of the recess 12. The piston rod 23 for the piston 24 of the pneumatic piston and cylinder unit 17 is fixed for rotation with respect to the cylinder 19 of the unit by means of longitudinal splines 24 so that the piston rod 23 is displaceable longitudinally (arrow F) in the ball joint while being fixed for rotation. In practice, the piston rod 23 slides longitudinally along splines 24 in a sleeve 29 fixed to the cylinder 19.

The tool holder spindle 16 is joined by the cylinder 19 of the piston and cylinder unit 17 via elastic coupling to drive means adapted to impart complex orbital movement to the tool. For this reason, the cylinder 19 of the pneumatic piston and cylinder unit 17 is sized to be fitted by an end piece 18 into an elastic block 26 accommodated in the rectangular cup member 27 which in turn is fixed to a front surface of a movable table 28 coupled to drive means adapted to displace it in two orthogonal directions which table is hereinafter referred to the compound table. The elastic block 26 and the cup member 27 together constitute the elastic block coupling 25.

The compound table 28 comprises (FIG. 3) on its rear face two bushes 30 and 31 adapted to slide along rods 32 and 33 the extremities of which are provided with sliders 34, 34A and 35, 35A which are adapted to slide along the rods 36 and 37 the latter rods 36 and 37 being perpendicular to the other rods 32 and 33 and fixed to a frame indicated by general reference number 38 which is fixed to the sidewalls of the cabinet.

Such an arrangement affords the compound table 28 displacement in two orthogonal directions respectively along the rods 32 and 33 and the rods 36 and 37.

Figure 4:
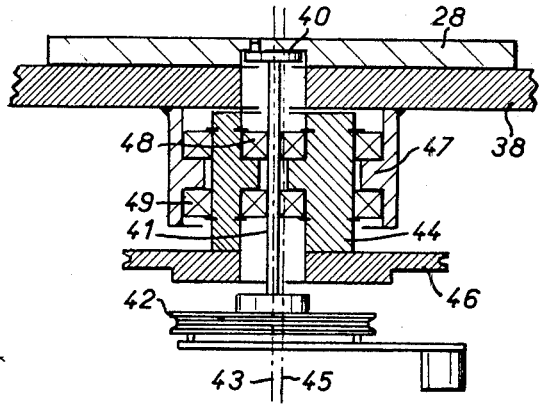
FIG. 4 is a sectional view taken on the line IV—IV in FIG. 3, this view showing the drive means for the compound movement table.

The compound table 28 is coupled to an eccentric drive mechanism shown in detail in FIG. 4. The eccentric drive mechanism comprises a first eccentric 40 coupled to the table and fixed for rotation at an end of a shaft 41 rotatable about a first axis 43 and carrying a first pulley 42. The eccentric drive mechanism also comprises a second eccentric 44 which is freely mounted on the shaft 41 and provides a pillow block therefor. A second pulley 46 is driven for rotation about a second axis 45. The second eccentric 44 is carried by a pillow block 47 fixed to the frame 38. Antifriction bearings, such as ball bearings 48 are obviously interposed between the shaft 41 and the second eccentric while other antifriction bearings, e.g. ball bearings 49, are interposed between the second eccentric and the bearing 47.

The aforesaid pulleys 42 and 46 have different diameters. On the other hand they are fixed for rotation with the same motor means which in this case is the output shaft of an electric motor 50 mounted on a wall 51 fixed at the top of the cabinet 13. The pulleys are conneted to the motor means by two transmission belts 52 and 53 and a tightening pulley 54 is arranged along the reeving of belt 52 on pulley 42 in order to compensate for the effects due to the second eccentric 44.

Figure 3:
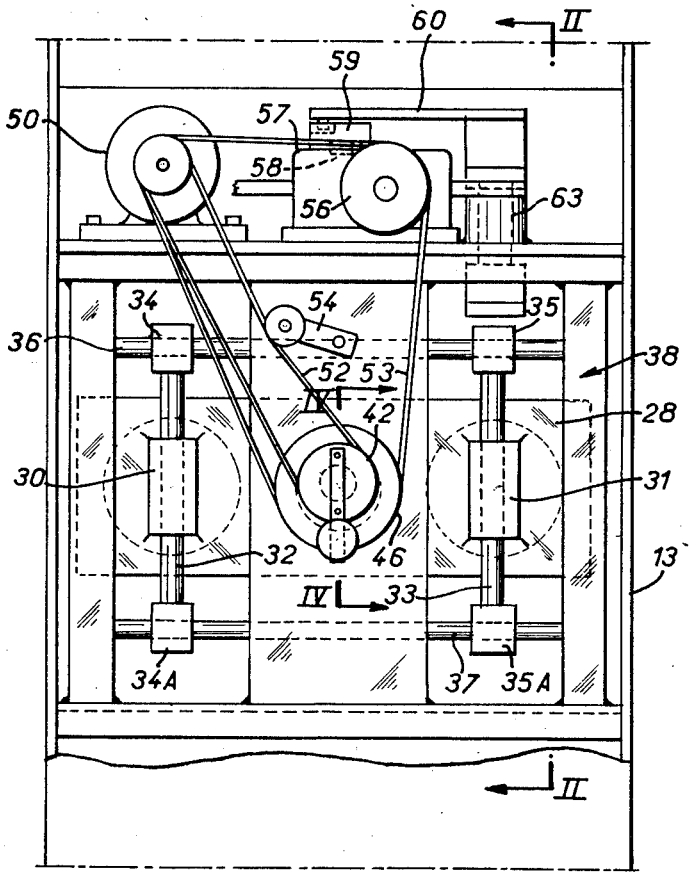
FIG. 3 is a rear view of the machine taken in the direction of the arrow F in FIG. 2.

The output shaft of motor 50 which is rotatable in each of two directions, alternately controlled for rotation in one direction and then the other, imparts swinging movement to the bearing heads 15 relative to the end of the tool holder spindle 16. Such swinging movement is produced by a transmission belt 53 of the second pulley 46 which also reeves a pulley 56 actuating reducing gear 57 having an output shaft 58 on which an eccentric 59 is fixed forming an alternating or reciprocating drive mechanism (FIG. 3).

Figure 5:
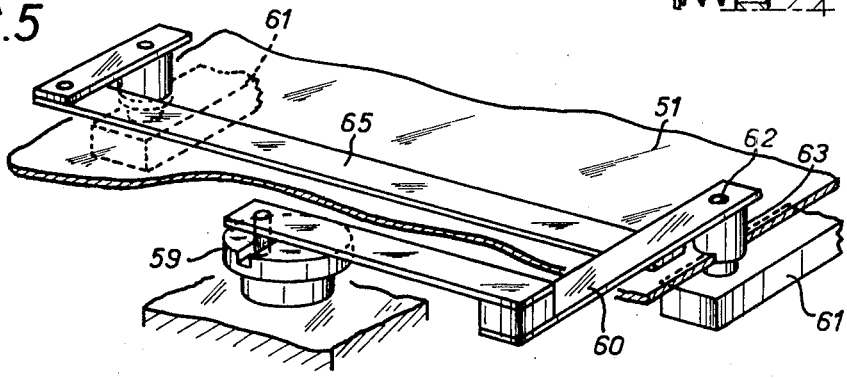
FIG. 5 is a perspective view of the alternating drive mechanism for the bearing heads.

The last eccentric, best seen in FIG. 5, is coupled to an end of a right-angled bellcrank 60 with its other end associated with the terminal part of an arm 61 carrying a bearing head 15 at its end. The interconnection between the bellcrank 60 and arm 61 is formed by a pivot 62 journalled in bearing 63 fixed to the wall 51. The bellcrank 60-arm 61 interconnection is formed by a pivot 62 swingingly mounted in a bushing 63 fixed to the wall 51. Ahead of the bushing 63 the bellcrank 60 carries a bellcrank lever 65 associated by a pivot and bushing with another arm 61 carrying the second bearing head 15.

Figure 6:
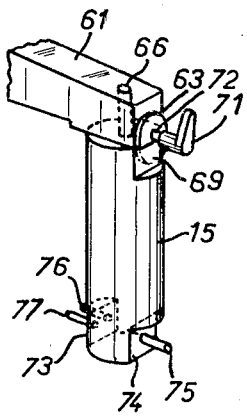
FIG. 6 is a fragmentary perspective view of a bearing head.

FIG. 6 illustrates the association of a bearing head 15 with an arm 61. In this figure is seen the bearing head 15 freely rotatably mounted on the arm 61 by means of a support pin or journal 66 and lockable or securable in a selected position. Accordingly, the bearing head 15 comprises at its top end a flat 69 adapted to lie in the continuation of the front end face of arm 61 which carries locking or securing means for locking or securing the bearing head in a selected position corresponding to the flat 69.

Such locking means comprise a handle 71 having an end threadedly engaged in the arm 61 with a shoulder 72. A semi-circular member 63 is freely mounted on the end portion of the handle 71 and is operable between a retracted position as shown in the figure in which the bearing head 15 is rotatable about pin or journal 66 or in an operative position as indicated in chain-dotted lines in the same figure in which the bearing head is locked against rotation by the overlapping of the end of the arm 61 and the flat 69 on the bearing head 15. The screwing of the handle 71 effects the locking of the semi-circular member 63.

At its lower end the bearing head 15 comprises two diametrically opposed flats 73 and 74 one of which is oriented like the flat 69, a single radial finger 75 being arranged on the latter and a pair of parallel radial bearing fingers 76 and 77 being arranged on the former.

The pin or journal 66 of a bearing head 15 extends generally transversely relative to the corresponding tool holder spindle 16 carrying a tool holder block 78 for a tool 79 facing the bearing fingers of the said bearing head.

Figure 7:
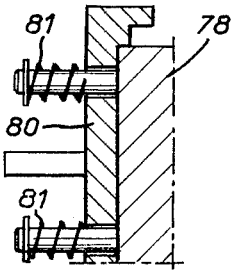
FIG. 7 is an enlarged sectional view taken on line VII—VII in FIG. 2.

The tool holder block 78 is provided with means for mounting and dismounting the tool advantageously comprising two diametrically opposed lateral jaws 80 one of which is rockably mounted against the action of return springs 81, as schematically shown in FIG. 7.

The tool holder block 78 carries a part having a frustoconical surface 82 acting as a splash guard for the slurry used in grinding or polishing from entering the immediate proximity of the tool holder spindle 16 and the drive means.

A pump as known per se supplies the slurry under pressure to a suitable oriented hose 84 and a screen 85 for screening foreign bodies from the slurry before it is recycled by the pump, is disposed at the bottom of the rectangular front recess in the cabinet.

Figure 2:
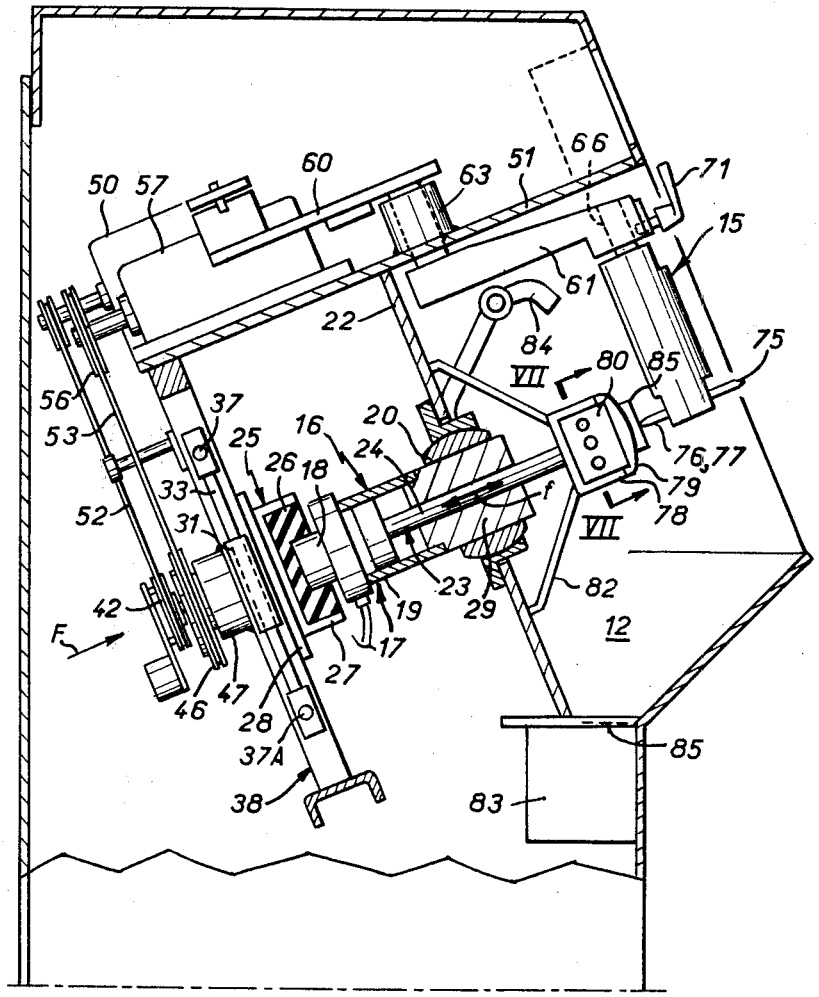
FIG. 2 is a vertical sectional view taken on a plane passing on the line II—II indicated in FIG. 3.

In operation for machining a toroidal or cylindrical surface on a lens blank 85 the lens blank is held in contact with the tool 79 by the corresponding bearing head 15, the bearing head being freely mounted for rotation around the support pin or journal 66 and oriented so that the lens blank 85 is held by two parallel bearing fingers 76 and 77 (FIG. 2).

Such a machine provides complex orbital movement of the tool holder spindle and swinging movement of the bearing head whereby during polishing or smoothing it is virtually impossible to repeat a cycle thereby producing flawless optically polished lens.

The invention is not limited to the illustrated embodiment but admits of various modifications without departing from the scope and spirit of the invention as defined by the appended claims. In this vein the splines provided for fixing the pneumatic piston and cylinder unit may be replaced by another such means for securing against relative rotation, e.g. self-resistant locking means. Further, the cylinder of the postion and cylinder unit may carrying the tool holder block receiving a tool, the piston rod of the piston and cylinder unit then being attached to associated drive means; in other words the respective functions of these parts may be reversed.

The rotary parts or means of the drive means may be sprocket and chain, for example, instead of the pulleys and transmission belts as described above.

The compound table may be controlled by some other kind of drive mechanism instead of eccentric drive mechanism. Moreover the unit may be replaced by any other means for imparting more or less complex orbital movement to spindle.

Finally, if toroidal or cylindrical surfaces are to be machined, the tool is mounted on the tool holder spindle, if on the other hand spherical surfaces are to be polished or machined the workpiece is disposed on this support of workpiece holder spindle as described in the introduction of the present application. In the first case, the bearng head is freely mounted for rotation and the parallel fingers are operational, in the second case it is fixed on its support axis and the single bearing finger is operational.

What is claimed is:

1. Apparatus for machining, polishing and or smoothing workpieces having curved surfaces, said apparatus being of the type comprising a tool holder spindle, a bearing head for maintaining a tool against a workpiece, pressure-applying means including a pneumatic piston and cylinder unit including a piston rod for establishing contact pressure between the workpiece and the tool, drive means also operatively disposed between said tool holder spindle and said bearing head for generating predetermined relative displacements between the workpiece and the tool, the improvement comprising said pneumatic piston and cylinder unit being part of said tool holder spindle and a selected one of said cylinder and said piston rod of said piston and cylinder unit being provided with a tool holder block for mounting said tool and the nonselected one of said cylinder and said piston rod being attached to said drive means, means for swivelly mounting said piston and cylinder unit, said drive means including a compound table connected to an eccentric drive means, and means interconnecting said tool holder spindle and said compound table including an elastic block coupling member, whereby constant pressure may be applied to said tool irrespective of its position relative to the workpiece.

2. Apparatus according to claim 1, wherein said piston rod of said piston and cylinder unit is fixed for rotation with said cylinder.

3. Apparatus according to claim 1, wherein said eccentric drive mechanism comprises a first eccentric attached to said compound table and fixed for rotation with a shaft carrying a rotary drive element and a second eccentric freely mounted on said shaft and acting as a support therefor, said second eccentric carrying a second rotary drive element.

4. Apparatus according to claim 3, wherein said drive elements comprise pulleys.

5. Apparatus according to claim 3, wherein said drive elements are of different diameters and are fixed for rotation with the same motor means.

6. Apparatus according to claim 5, comprising means for alternately driving said motor means in opposite directions.

7. Apparatus according to claim 1, wherein said bearing head is freely mounted and securable in position on a support element extending transversely relative to said tool holder spindle, said bearing head having at diametrically opposed positions relative to said support element a single bearing finger and a pair of parallel bearing fingers respectively.

8. Apparatus according to claim 1, wherein said bearing head is disposed at an end of an arm fixed for rotation on reciprocating means for imparting swinging movement relative to said tool holder spindle.

9. Apparatus according to claim 7, wherein said bearing head comprises means for securing it in position including a flat cooperable with a movable member having a retracted position for permitting rotation of said bearing head about said support element and an operative position for securing said bearing head against rotation, and in the operative position said movable member overlies both an end of an arm in which said support element is received and said flat on said bearing head.

* * * * *